United States Patent [19]

Schantz

[11] 4,017,923

[45] Apr. 19, 1977

[54] FINGER NAIL RETAINER AND TWEEZER

[75] Inventor: John S. Schantz, Marine, Ill.

[73] Assignees: Raymond G. Shantz; Socrates J. Schantz, both of Marine, Ill. ; part interest to each

[22] Filed: Mar. 10, 1976

[21] Appl. No.: 665,554

[52] U.S. Cl. ..... 7/1 C; 81/43; 30/124; 294/99 R

[51] Int. Cl.[2] ..... B25F 1/00; B25B 9/02

[58] Field of Search ..... 7/1 C, 1 R, 1 P; 81/43; 30/28, 124, 125; 294/99 R

[56] References Cited

UNITED STATES PATENTS

| | | | |
|---|---|---|---|
| 2,829,433 | 4/1958 | Killen | 30/28 |
| 2,887,773 | 5/1959 | Killen | 30/28 |

*Primary Examiner*—Al Lawrence Smith
*Assistant Examiner*—Roscoe V. Parker
*Attorney, Agent, or Firm*—Glenn K. Robbins

[57] ABSTRACT

A finger nail retainer and tweezer for use with a conventional nail clipper. The retainer and tweezer is used with a conventional nail clipper having a pair of elongated cutting blades fastened together at a rear end and having cutting blades at a forward end. The retainer and tweezer is made of spring steel and is of a generally V-shaped construction fitting over the pair of cutting blades and covering the space therebetween to retain nail clippings. The retainer and tweezer when removed from the nail clipper can be squeezed together and serve a particularly advantageous function as a tweezer. The retainer is simply adapted to be fitted over the nail clipper by inturned bottom flanges on the arms and inturned guide elements spaced above the flange elements to bit over the opposed sides of the bottom cutter blade while permitting the movement of the uppermost cutter blade. The flange form a narrow throat at the rear and an enlarged opening receiving a key ring. The throat restricts passage of the key ring but can be widened by spreading apart the retainer arms to pass the key ring to disengage the retainer therefrom.

4 Claims, 8 Drawing Figures

FINGER NAIL RETAINER AND TWEEZER

BACKGROUND OF THE INVENTION

In the past nail clippers have been conventionally employed for clipping finger and toe nails having an elongated pair of cutting blades fastened together at the rear end and using a spring action and an operating lever to cut nails. The clippings fly in random direction and have been a problem with regard to the collection thereof. These clippings are expelled from the rear of the cutting blades and through the opening at the sides thereof. Devices have been proposed for the retention of the nail clippings such as in Killen U.S. Pat. No. 2,829,433 and Killen U.S. Pat. No. 2,887,773. These nail clipper cutting retainers cover the side plates of a cutter blades but the retainers are not readily removable and have no function as a tweezer.

By means of this invention there has been provided a nail clipping retainer and tweezer which is very simply adapted for use with conventional nail clippers of the type described. The retainer of this invention is very simply designed for use with the conventional nail clipper by V-shaped arms which are movable together and held by a biasing action against the sides of the bottommost cutter blade. The engaging action is accomplished by inturned flanges and inturned dimple-like guide elements spaced above the flanges which receives the opposed sides of the bottommost cutter blade of the clipper so that the retainer is held tightly thereagainst. The retainer is very simply disengaged from the clipper by means of an enlarged finger receiving portion at the top of the free ends of the retainer arms which receives a finger nail of the user for easy grasping of the arms for spreading apart. The spreading apart effects disengagement from the clipper for emptying nail clippings.

The V-shaped retainer arms further serve as a tweezer. The front of the arms are tapered and turned inwardly which enhance the use as a tweezer. The free ends of the retainer arms through their tapering and turned inward construction further serve to close the space between the front of the cutting blades to retain the clippings and also to closely bear against the clipper by the spring or biasing action of the V-shaped arm construction. The retainer is simply retained on a key ring when it is disengaged from the clipper. This construction is accomplished by the inturned flanges to provide a narrow throat at the rear portion of the retainer which receives a key ring in an enlarged opening. The retainer arms are simply spread apart to enlarge the throat from the key ring blocking position to a key ring passing position.

Objects of this invention will appear in the detailed description which follows and will be otherwise apparent to those skilled in the art.

For the purpose of illustration of this invention there is shown in the accompanying drawings a preferred embodiment thereof. It is to be understood that these drawings are for the purpose of illustration only and that the invention is not limited thereto.

IN THE DRAWINGS

DESCRIPTION OF THE INVENTION

Figure 1:
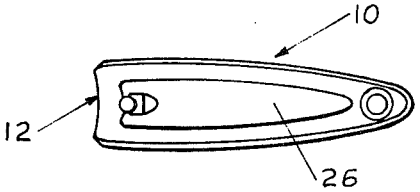
FIG. 1, is a top plan view of the retainer attached to a nail clipper.
Figure 2:
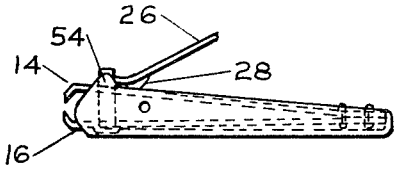
FIG. 2, is a side elevation of the retainer and clipper shown partially in dotted lines.
Figure 6:
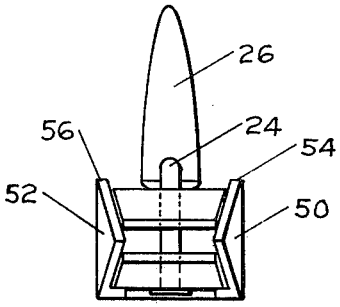
FIG. 6, is an enlarged view in front elevation of the clipper and retainer showing the clipper ready for use.
Figure 8:
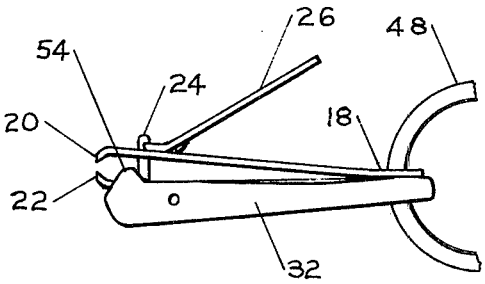
FIG. 8, is a view in side elevation of the clipper and retainer on a key chain with the retainer partially disengaged from the clipper.

The retainer of this invention is best shown in FIGS. 1, 2 and 8 identified by reference numeral 10 and attached to a conventional nail clipper 12 of conventional construction. The nail clipper has an upper arm 14 and lower arm 16 fastened together at a rear end 18 to provide a spring action. The clipper arms have at their front ends an upper cutting blade 20 and lower cutting blade 22, respectively, which perform the nail clipping or cutting action. A pivot pin 24 is connected to the lower and operating lever 26 attached to the pin is moveable from a disengaged position as shown in FIG. 1, to an operating position as shown in FIGS. 2, 6 and 8. A stud 28 on the operating lever 26 bears against the upper arm 14 to move the cutting blade 20 against the lower cutting blade 22 to effect the nail clipping action. In this nail clipping operation without the nail clipping retainer nail clippings will be ejected forcefully in the space at the sides of the upper and lower arms of the clipper unless there is some sort of nail clipping retaining action.

Figure 3:
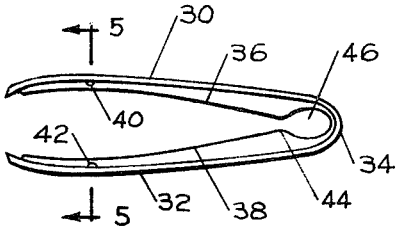
FIG. 3, is a top plan view of the retainer.
Figure 4:
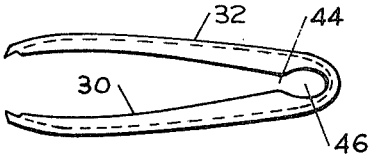
FIG. 4, is a bottom plan view of the retainer.
Figure 5:
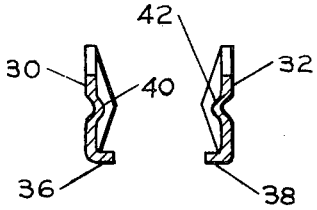
FIG. 5, is an enlarged view in cross section taken on the line 5—5 of FIG. 3.
Figure 7:
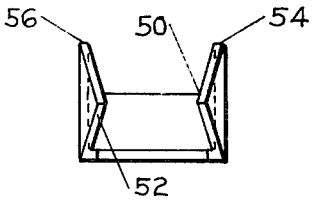
FIG. 7, is an enlarged view in front elevation of the retainer.

The retainer and tweezer of this invention is comprised of a pair of arms 30 and 32 having a V-shaped construction connected through bight portion 34. The arms have inturned bottom flanges 36 and 38 which bear against the bottom of opposite sides of the lower nail clipper arm 16. Inturned dimple-like guide elements 40 and 42 retain the top of the sides of the clipper bottom arm 16 as best shown in FIGS. 2 and 5. The inturned flanges as best shown in FIGS. 3 and 4 provide a throat portion 44 and an enlarged opening 46 at the bight portion of the retainer. The opening 46 receives a key ring 48 as shown in FIG. 8 which is retained by the narrow throat portion 44. The retainer arms can be simply spread apart to pass the key ring and disengage the retainer therefrom.

The retainer arms 30 and 32 are slightly bowed as shown in FIGS. 3 and 4 to fit and bear against the slightly bowed sides of the nail clipper. The forward portion of the arms are slightly turned inwardly and are tapered at 50 and 52. This construction serves dual function to close the forward area between the upper and lower clipper arms and also to serve as an object grasping portion for the tweezer.

The top of both of the retainer arms have raised portions 54 and 56 which readily receive the finger nail of the user. This facilitates grasping the two arms and spreading them apart for disengagement from the clipper to remove nail clippings.

USE

The nail clipping retainer and tweezer of this invention is simly employed with the nail clipper 12. For attachment to the clipper, the retainer shown in FIG. 3, is slightly spread apart and moved from the rear of the nail clipper to the forward position so that the inturned flanges and the guide elements receive the opposed sides of the bottom blade of the clipper. The retainer is maintained on the clipper through the biasing action of the arms and also the inturned pointed portions of the free ends of the retainer arms which fit over the openings at the front of the upper and lower arms and cutting blades of the nail clipper. In the attached or engaged position the retainer is simply employed with the nail clipper and does not interfere with the action in any way.

The nail clipper in the operating handle disengaged position of FIG. 1, is ready for use by simply turning the handle to the position in FIG. 2 where the clipper is then ready for use. The clipper is used in the conventional fashion by pressing the operating lever 26 down to move and force the upper blade 14 against the bottom blade 16 to cut finger or toe nails. Clippings ejected by the upper and lower cutting blades are retained by the retainer arms which cover the space at the sides between the nail clipper arms. The retention of the retainer on the clipper is accomplished through the inturned flange and the dimple-like guide elements which engage only the sides of the bottom arm of the clipper and do not interfere with the upper arm of the clipper.

When it is desired to remove the nail clippings from the retainer this is accomplished by grasping either of the enlarged portions 54 or 56, or both, at the top of the retainer arms and spreading the retainer arms apart and lowering the retainer as shown in FIG. 8. The clippings can be then emptied into a waste basket or the like.

The clipper and retainer can be fastened to a key ring or the like as shown in FIG. 8. When it is desired to remove the retainer completely from the key ring this is simply effected by spreading apart the free ends of the retainer arms to widen the throat portion 44 to pass the key ring. The retainer is made of spring steel which facilitates the spring-like action.

The retainer and tweezer of this invention serves a further use as tweezer. When removed from the nail clipper the spring-like action of the V-shaped arms of the retainer combined with the pointed and inturned ends when the retainer arms are closed together, facilitates the grasping of small objects such as clippings, hairs or the like. The spring-like action of the retainer arms thus serves a dual function for use as a tweezer and also for grasping or closely engaging the bottom arm of the nail clipper in the nail clipping retaining feature of the invention.

Changes and modifications may be made within this invention as will readily apparent to those skilled in the art. Such changes and modifications are within the scope and teaching of this invention as defined by the claims appended hereto.

I claim:

1. A nail clipping retainer and tweezer for use with a nail clipper having a pair of elongated cutting blades fastened together at a rear end and spaced apart at a forward end by spring action and having a retractable operating lever moveable form a flat rest position on the top of an uppermost one of the blades to a raised operating position where it can force said blade from an open position to a closed cutting position against a bottommost one of the blades, said retainer being of generally V-shaped construction formed by two arms connected to one another in spring-like relation at a bight portion and having diverging free front ends moveable against each other, said retainer being adapted to fit in close biasing relation with the arms engaging the outer edges of the pair of cutting blades and covering the space therebetween said retainer arms having inturned bottom flanges and inturned guide elements spaced above the flanges to receive the opposed sides of the bottommost cutter blade therebetween, said retainer when removed from the cutter being manually operable to cause the front ends of said arms to be forced together for use as a tweezer.

2. The retainer of claim 1, in which the free ends of the retainer arms are tapered and turned inwardly to close the space between the front of the cutting blades and provide a pointed nose tweezer when the retainer is removed from the nail clipper.

3. The retainer of claim 1, in which the upper part of the free ends of the retainer arm have a raised portion receiving the finger nail of the user for ease in grasping the arm and spreading apart for disengagement from the forward position of the clipper to empty nail clippings.

4. The retainer of claim 1, in which the inturned flanges are closely spaced from one another near the bight portion to provide a narrow throat between a diverging forward portion of the retainer and an enlarged opening at a rear portion of the retainer, said opening receiving a key ring for support of the retainer thereon, said retainer arms being spread apart to enlarge the throat from a key ring blocking position to a key ring passing position.

* * * * *